US008177656B2

(12) United States Patent
Bittner

(10) Patent No.: US 8,177,656 B2
(45) Date of Patent: May 15, 2012

(54) PUTTER TRAINING SYSTEM

(76) Inventor: Norman Douglas Bittner, St. Helena Island, SC (US)

( * ) Notice: Subject to any disclaimer, the term of this patent is extended or adjusted under 35 U.S.C. 154(b) by 0 days.

(21) Appl. No.: 13/210,741

(22) Filed: Aug. 16, 2011

(65) Prior Publication Data

US 2011/0300960 A1 Dec. 8, 2011

Related U.S. Application Data

(60) Division of application No. 12/974,721, filed on Dec. 21, 2010, now Pat. No. 8,047,928, which is a continuation-in-part of application No. 12/268,231, filed on Nov. 10, 2008, now Pat. No. 8,002,643.

(51) Int. Cl.
*A63B 69/36* (2006.01)

(52) U.S. Cl. ..... 473/265; 473/226; 473/237

(58) Field of Classification Search ..... 473/219, 473/222, 223, 225, 226, 237, 238, 242, 257, 473/266, 278, 326
See application file for complete search history.

(56) References Cited

U.S. PATENT DOCUMENTS

| | | | | |
|---|---|---|---|---|
| 2,090,348 | A | 8/1937 | Ferry | |
| 2,995,376 | A | 8/1961 | Leo | |
| 3,311,377 | A | 3/1967 | Holbus | |
| 3,687,459 | A * | 8/1972 | Swords | 473/237 |
| 3,885,796 | A | 5/1975 | King | |
| 3,945,646 | A | 3/1976 | Hammond | |
| 3,992,013 | A | 11/1976 | Golden | |
| 4,137,566 | A | 1/1979 | Haas et al. | |
| 4,155,555 | A | 5/1979 | Fink | |
| 4,251,077 | A | 2/1981 | Pelz et al. | |
| 4,254,956 | A | 3/1981 | Rusnak | |
| 4,304,406 | A | 12/1981 | Cromarty | |
| 4,341,384 | A | 7/1982 | Thackrey | |
| 4,535,992 | A | 8/1985 | Slagle | |
| 4,615,526 | A | 10/1986 | Yasuda et al. | |
| 4,858,934 | A | 8/1989 | Ladick et al. | |
| 4,958,836 | A | 9/1990 | Onozuka et al. | |
| 4,962,931 | A | 10/1990 | Jazdzyk, Jr. | |
| 4,971,325 | A | 11/1990 | Lipps | |
| 4,979,745 | A | 12/1990 | Kobayashi | |
| 5,020,802 | A | 6/1991 | af Strom | |
| 5,282,627 | A | 2/1994 | Beck | |
| 5,419,562 | A | 5/1995 | Cromarty | |
| 5,435,547 | A | 7/1995 | Lee | |
| 5,501,463 | A | 3/1996 | Gobush et al. | |
| 5,614,823 | A | 3/1997 | Katayama et al. | |
| 5,638,300 | A | 6/1997 | Johnson | |
| 5,685,782 | A | 11/1997 | Lipps et al. | |
| 5,907,819 | A | 5/1999 | Johnson | |
| 6,095,928 | A | 8/2000 | Goszyk | |
| 6,287,215 | B1 | 9/2001 | Fisher | |
| 6,361,449 | B1 | 3/2002 | Holly | |
| 6,375,579 | B1 | 4/2002 | Hart | |
| 6,739,981 | B1 | 5/2004 | Lin | |

(Continued)

*Primary Examiner* — Nini Legesse
(74) *Attorney, Agent, or Firm* — Nixon & Vanderhye P.C.

(57) ABSTRACT

A putter training system includes a putter with putter head, an attachment secured adjacent the putter head, and a grid having sidewalls and a grid bottom. The putter head includes a bottom, a top and a face, where the top has at least one putter alignment line appearing thereon. The grid sidewalls are spaced apart by a distance larger than a length of the putter head. The grid bottom includes at least one grid alignment line cooperable with the at least one putter alignment line to facilitate alignment perception during a putting stroke. Additionally, the attachment is cooperable with the grid bottom to facilitate alignment feedback during the putting stroke.

10 Claims, 11 Drawing Sheets

U.S. PATENT DOCUMENTS

| | | | | |
|---|---|---|---|---|
| 6,849,001 | B2 * | 2/2005 | Simpson | 473/226 |
| 6,875,120 | B1 | 4/2005 | Ellis | |
| 6,913,544 | B2 | 7/2005 | Tiffin | |
| 7,232,375 | B1 | 6/2007 | Robert et al. | |
| 7,824,276 | B2 * | 11/2010 | Simpson | 473/226 |
| 7,955,180 | B2 | 6/2011 | Bittner | |
| 8,002,643 | B2 | 8/2011 | Bittner | |
| 2001/0005695 | A1 | 6/2001 | Lee et al. | |
| 2002/0077189 | A1 | 6/2002 | Tuer et al. | |
| 2005/0197198 | A1 | 9/2005 | Otten et al. | |
| 2006/0029916 | A1 | 2/2006 | Boscha | |
| 2007/0249428 | A1 | 10/2007 | Pendleton et al. | |

* cited by examiner

PUTTER TRAINING SYSTEM

CROSS-REFERENCES TO RELATED APPLICATIONS

This application is a divisional of U.S. patent application Ser. No. 12/974,721, filed Dec. 21, 2010 now U.S. Pat. No. 8,047,928; which is a continuation-in-part of U.S. patent application Ser. No. 12/268,231, filed Nov. 10, 2008 now U.S. Pat. No. 8,002,643, the entire content of each of which is hereby incorporated by reference in this application.

STATEMENT REGARDING FEDERALLY SPONSORED RESEARCH OR DEVELOPMENT (NOT APPLICABLE)

BACKGROUND OF THE INVENTION

The present invention relates to golf equipment and, more specifically, to golf training equipment.

The traditional "pendulum swing" of a putter, used by most modern golfers, has too many random variables such as the height of the swing, distance of the backswing, speed of the club head on return to the ball for the strike, direction of the aim of club head, and rotation of the club head for the mind and muscles to be adequately trained for a consistently successful putt. The traditional pendulum swing is confronted with infinite variables for every putting event and is not recordable and correctable with a device of sufficient capacity that enables making corrections in the putting event. The "pendulum swing" faces its own unique direction, undulation and speed requirements with little opportunity for correction.

Various prior art documents disclose a method and apparatus for training a golfer in practicing traditional "pendulum swing" of a putter as described below.

U.S. Published Patent Application No. 2006/0029916 A1 (Boscha) discloses a golf putter for training a golfer, wherein the golf putter has a handle, a head, and sensing unit for sensing parameters. U.S. Published Patent Application No. 2007/0249428 A1 (Pendleton, et al.) discloses a putting training device comprising a surface over which a golfer executes a putting stroke, an electric field generator, an electric field detector, a plurality of electrodes responsive to the electric field generator each for producing an electric field and wherein as the golfer executes the putting stroke one or more of the electric fields is perturbed, and wherein the electric field detector detects the perturbed electric field to determine parameters related to putter head movement. U.S. Pat. No. 6,375,579 B1 (Hart) discloses a dynamic laser based golf swing analysis system having single and multiple laser sources which broadcast a monochromatic laser light projected through a cylindrical lens system to generate a series of light planes in space.

In contrast to the "pendulum swing," a "piston motion" reduces the number of variables effecting putting to a more manageable replication, making it possible to "burn" into one's muscle memory a consistent pattern and result. There are new visual, postural and muscle memory events in the "piston motion" technique that are in conflict with traditional approaches to putting—for instance, the stroke contacts the ball at the end of a motion that is as nearly perfectly straight in three dimensions as possible. There is no rotation of the club head. There is little or no elevation of the club head off the putting surface that is sufficient for clearance from the ground to generate a smooth path.

BRIEF SUMMARY OF THE INVENTION

A purpose of the present invention is to provide a golf system for training a golfer to practice a non-traditional stroke which is similar to the motion of a piston. It is an object to provide a golf putter comprising a club head which is specially designed to facilitate a piston-like motion and a plurality of marking instruments for marking and recording the trajectory and thus guiding the correct execution for the desired motion for correct direction and distance.

It is another object to provide a "grid" for guiding the motion of the golf putter. The "grid" comprises an enclosure, a recording device to record the trajectory of the golf putter, a plurality of guiding rails and an optional leveling device as well as an optional aiming device in the form of a moveable protractor-like instrument.

It is still another object to provide a ruler and/or permanent and/or removable gradient color guide to determine the distance by which the putter has to be drawn back as a function of distance between a golf ball and cup.

It is still another object to provide a direction guide to record the path of the golf ball after it is stroked. After the ball is hit, the golfer can look at his tracking device and see why his putt was perfect or imperfect.

U.S. patent application Ser. No. 12/475,394 (Bittner), the contents of which are hereby incorporated by reference, describes a specialized putter designed to train a golfer in the "piston motion."

In an exemplary embodiment, a putter training system includes a putter with putter head, an attachment secured adjacent the putter head, and a grid having sidewalls and a grid bottom. The putter head includes a bottom, a top and a face, where the top has at least one putter alignment line appearing thereon. The grid sidewalls are spaced apart by a distance larger than a length of the putter head. The grid bottom includes at least one grid alignment line cooperable with the at least one putter alignment line to facilitate alignment perception during a putting stroke. Additionally, the attachment is cooperable with the grid bottom to facilitate alignment feedback during the putting stroke.

The top of the putter head may include three putter alignment lines appearing thereon, and the grid bottom may include a corresponding three grid alignment lines. In this context, the putter alignment lines and the grid alignment lines are equally spaced and similarly oriented relative to one another.

The attachment may include a stylus having a marking end disposed below the bottom of the putter head. The stylus is positioned to mark the grid bottom according to a path of the putter head during the putting stroke. In one arrangement, the grid bottom has a markable surface, and the stylus is a pencil. Alternatively, the grid bottom may be a touch sensitive or light sensitive electronic screen, where the stylus is an implement that is cooperable with the electronic screen. In still another alternative, the attachment is an aiming plate secured adjacent the putter head. The aiming plate includes at least one plate alignment line in line with the at least one putter alignment line. The system may include interchangeable attachments including, for example, a pencil stylus with a marking end disposed below the bottom of the putter head, an electronic stylus cooperable with a touch sensitive or light sensitive electronic screen, and an aiming plate secured adjacent the putter head.

In another exemplary embodiment, an attachment assembly is securable to a putter for use as a training aid. The attachment assembly is universal and attachable to any putter or other club. The attachment assembly includes a first bracket securable to a hosel of the putter, a second bracket connected to the first bracket, and an attachment secured to the second bracket. The second bracket is adjustable relative to the first bracket to position the attachment in a use position adjacent the putter head.

BRIEF DESCRIPTION OF THE DRAWINGS

The present invention can be more easily understood and the advantages and uses thereof more readily apparent when the following detailed description of the present invention is read in conjunction with the figures, wherein.

In accordance to common practice, the various described features are not drawn to scale (unless denoted otherwise), but are drawn to emphasize specific features relevant to the invention. Like reference characters denote like elements throughout the figures and text.

DETAILED DESCRIPTION OF THE INVENTION

Before describing the invention in detail, it should be observed that the present invention resides primarily in a novel and non-obvious combination of elements and process steps. So as not to obscure the disclosure with details that will readily be apparent to those skilled in the art, certain conventional elements and steps have been presented with lesser detail, while the drawings and specification describe in greater detail other elements and steps pertinent to understanding the invention.

The following embodiments are not intended to define limits as to the structure of method of the invention, but only to provide exemplary constructions. The embodiments are permissive rather than mandatory and illustrative rather than exhaustive.

(1) The Design of the Golf Putter

Figure 1:
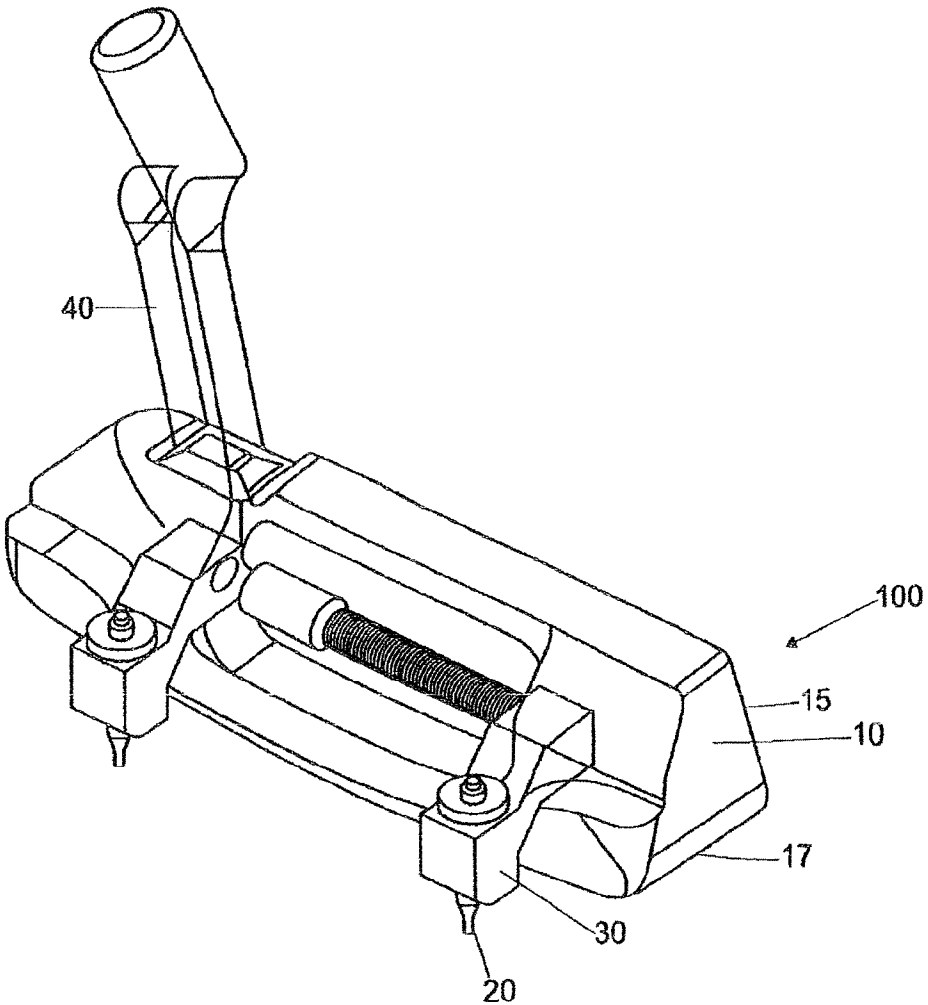
FIG. 1 depicts a golf putter with plurality of marking instruments.

FIG. 1 illustrates a golf putter 100 designed for training a golfer in practicing an unconventional style of stroke similar to the motion of a piston. The putter 100 has a club head 10 to be fixed to a shaft. The club head 10 has a housing 30 which contains marking instruments 20 for marking the trajectory of the swing of the putter 100. Various types of housings can be used such as a housing having a restraining arm connected with a spring which allows for easy attachment and detachment of the marking instruments 20. Several other means can also be used for holding the marking instruments 20 without altering the scope of the invention.

The marking instruments 20 can be styluses, sensors, or implements capable of making temporary and/or indelible marks on the surface below the putter 100. The trajectory of the putter 100 is sketched by the marking instruments 20 on a recording device, and the recorded trajectory can be used by the golfer to analyze his or her strokes and practice the piston-like motion.

Figure 2B:
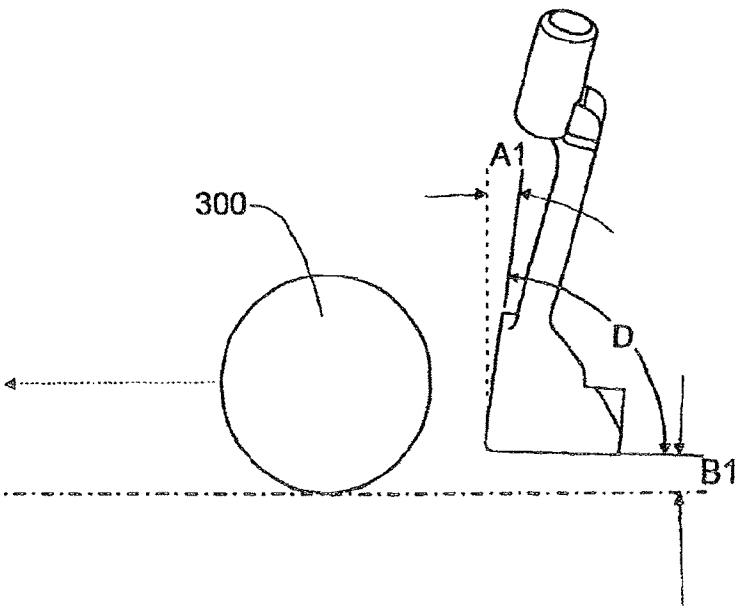
FIGS. 2*a* and 2*b* depict orientation of the club head of the putter before and after hitting a golf ball.
Figure 2A:
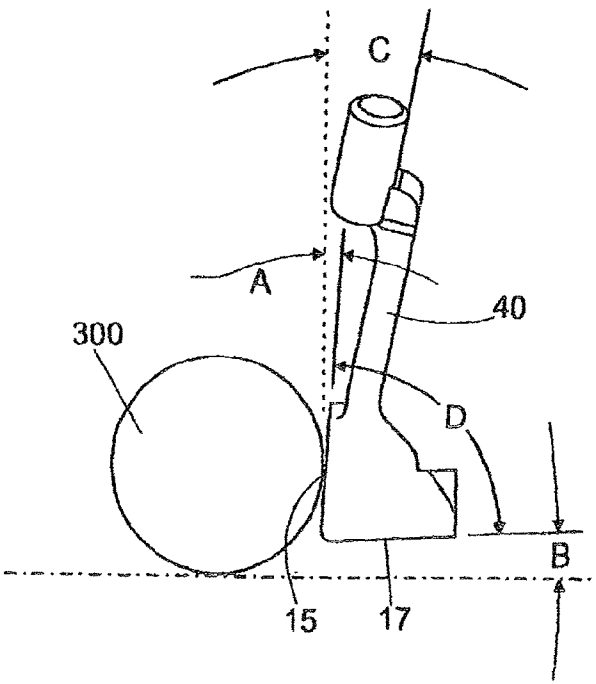

FIG. 2*a* illustrates face angle A (the angle between the face 15 of the club head 10 and the vertical axis), shoe angle B (the angle between the shoe 17 of the club head 10 and the horizontal axis), and hosel angle C (the angle between the hosel 40 of the club head 10 and the vertical axis). These angles have been modified so as to facilitate the piston-like motion of the putter 100.

When the putter 100 is in contact with a golf ball 300, face angle A is (−) 4 degrees and the shoe angle B is (−) 2 degrees and hosel angle C is (−) 12 degrees. The club head 10 is designed such that the face 15 of the club head 10 is at an angle of 84 degrees (D) to the shoe 17 of the club head 10.

After the ball 300 is hit, the face angle A and the shoe angle B change as illustrated in FIG. 2*b*. After contact, the face angle A1 is (−) 8 degrees and the shoe angle B1 is (+) 2 degrees.

(2) The Design of the Grid

Figure 3:
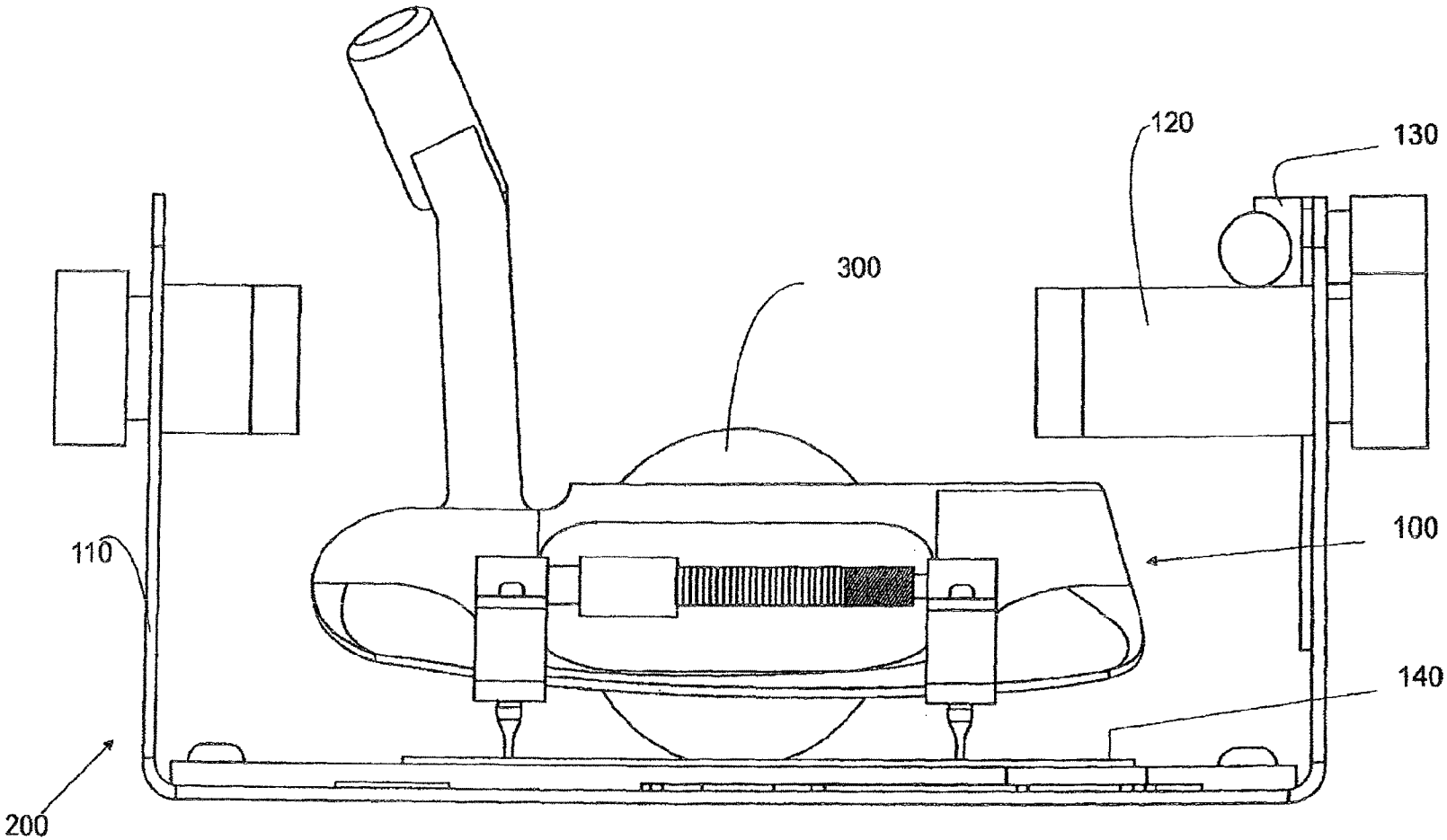
FIG. 3 depicts the golf putter addressing the golf ball in a grid.

FIG. 3 illustrates a grid 200 which is adapted to be used with the putter 100 to train the golfer in practicing and analyzing his or her strokes. The grid 200 guides the movement of the club head 10 of the putter 100 and thus the motion of the golfer's body, thereby allowing for replication of the piston-like stroke and development of muscle memory.

Figure 4A:
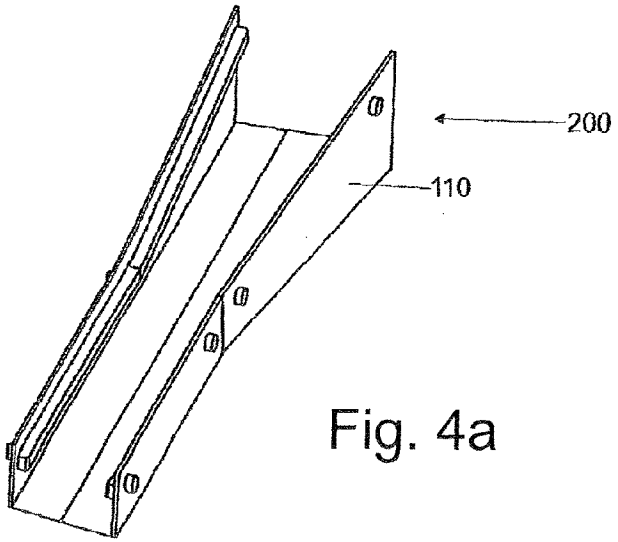
FIGS. 4*a-c* depict the grid for training a golf player.

As illustrated in FIG. 4*a*, the grid 200 comprises an enclosure 110 in which the golfer addresses the golf ball 300. The enclosure 110 has different cross sections at its ends. The end of the enclosure having a wider cross section is positioned away from a cup 400.

Figure 4B:
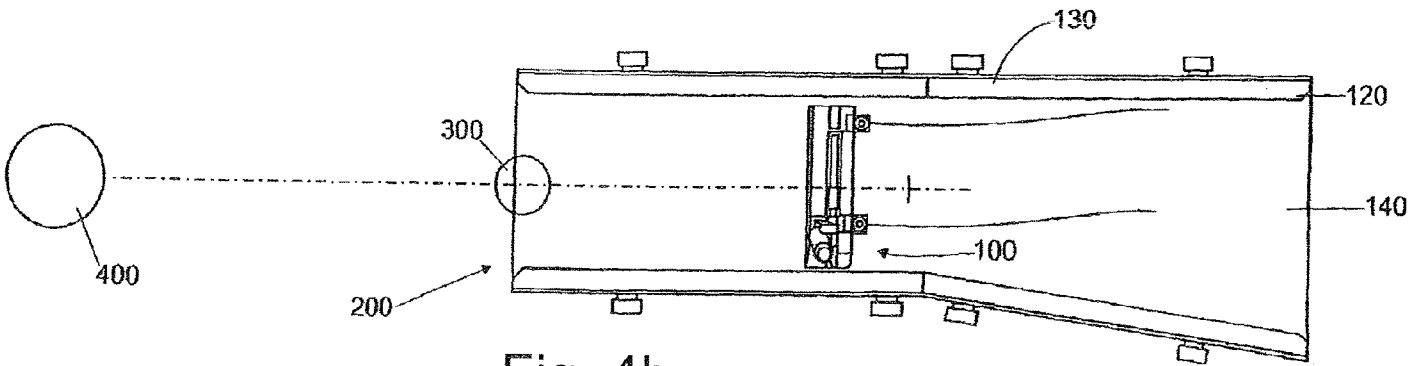

As shown in FIGS. 3 and 4*b*, the grid 200 has adjustable guiding rails 120 which are adjustably attached to the enclosure 110 for guiding the motion of the club head 10 of the putter 100. The club head motion is replicated into a pattern that can be comfortably memorized by the eye and muscle.

A leveling device 130 is disposed in the grid 200 to compensate for uphill and downhill putts. The gradient of the enclosure 110 can be adjusted with the help of the leveling device 130. Depending on the gradient of the enclosure 110, the golfer can change the velocity with which he or she hits the golf ball 300.

Figure 4C:
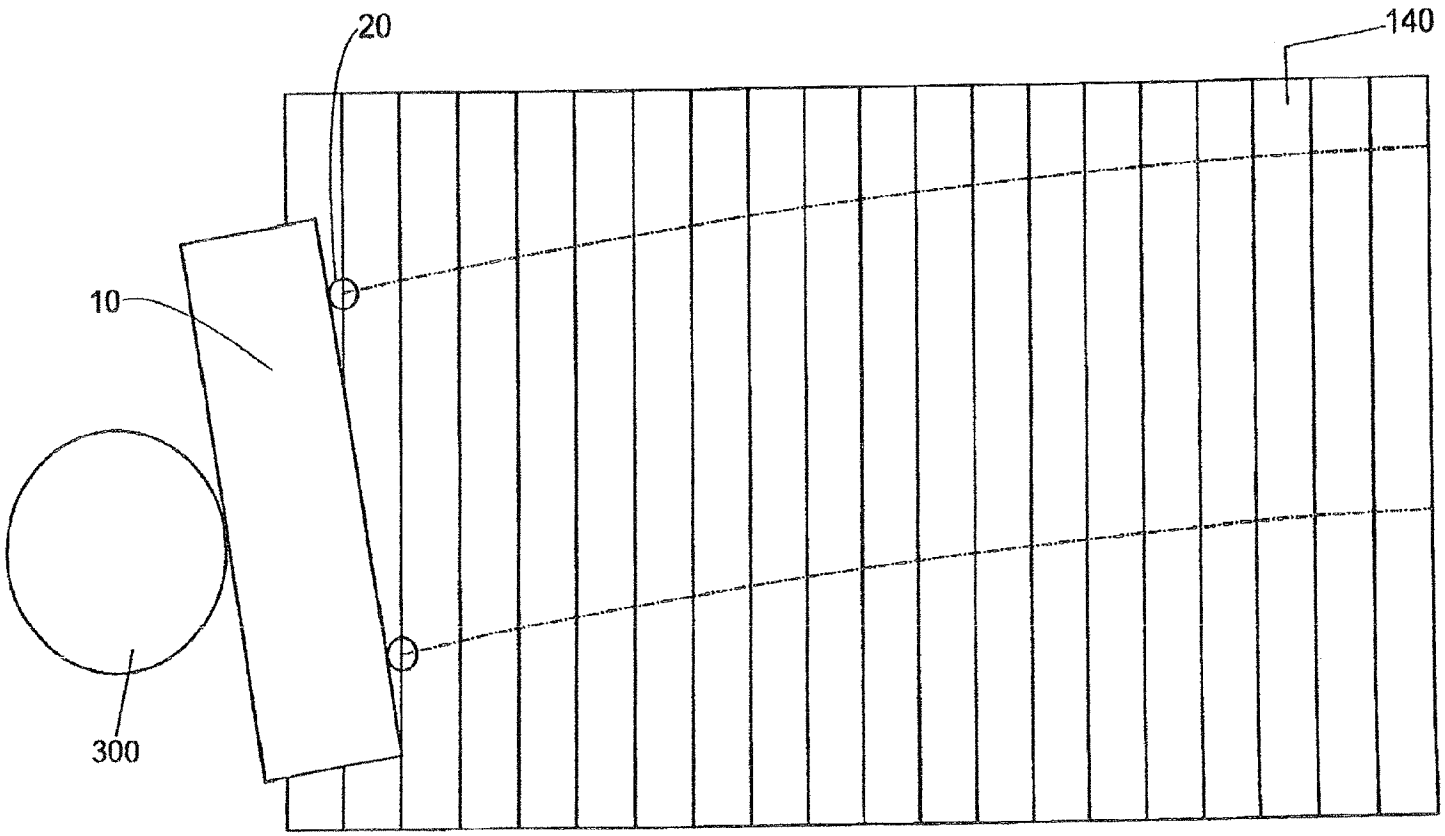

The marking instruments 20 of the putter 100 work in conjunction with a recording device 140 attached to the bottom of the enclosure 110 to record the trajectory of the swing of the putter 100 as illustrated in FIG. 4*c*. The recording device 140 could be a pressure sensitive paper, electronic screen or the like.

In another embodiment of the present invention, the bottom of the enclosure 110 contains a ruler and/or gradient color guide to determine the distance by which the putter 100 has to be drawn back as a function of distance between the ball 300 and the cup 400.

Figure 5A:
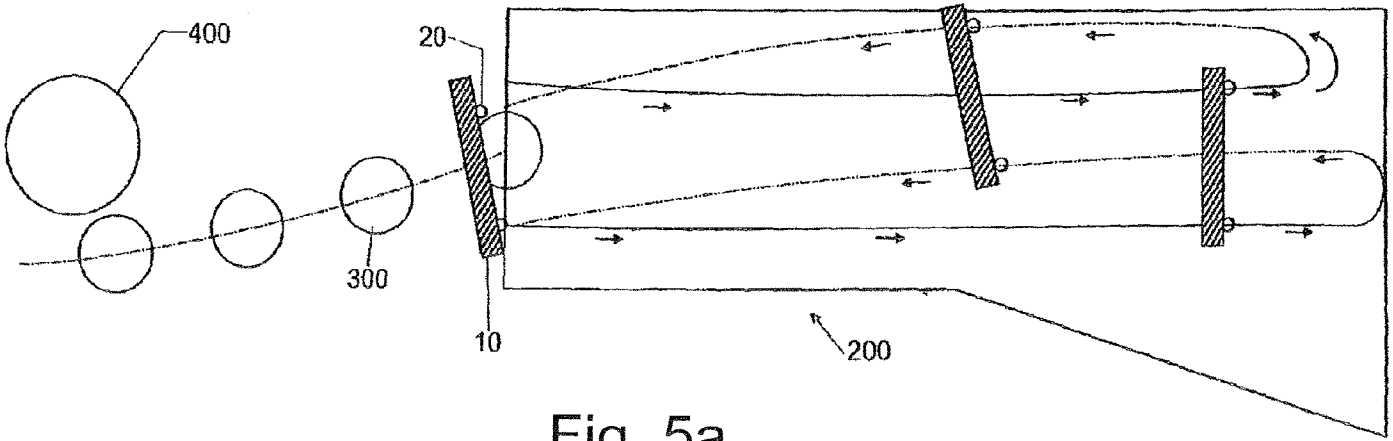
FIGS. 5*a* and 5*b* depict various trajectories of the putter depending on the path and strike of the club head of the putter.
Figure 5B:
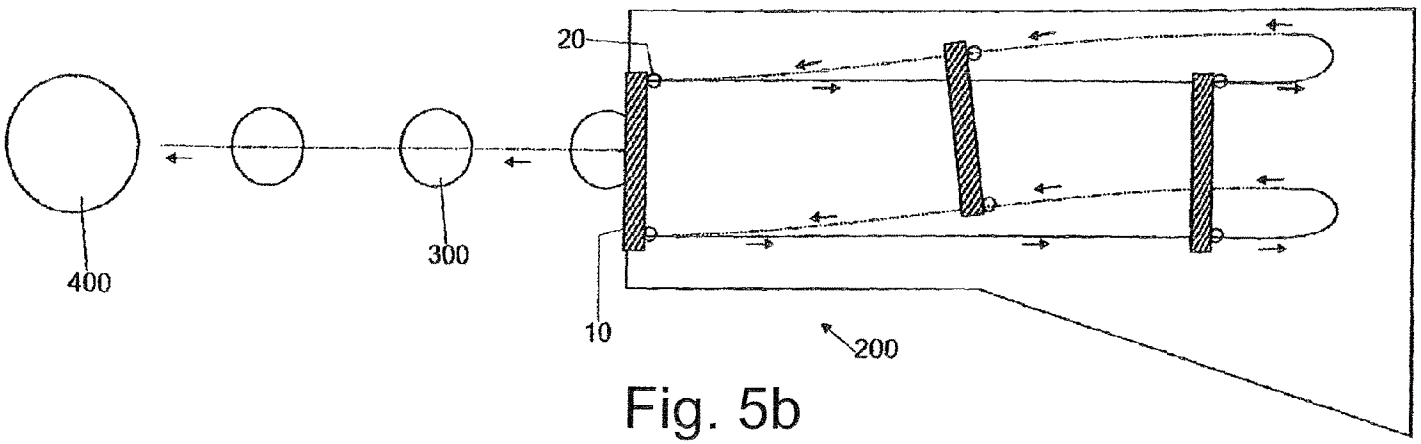

FIG. 5*a* illustrates an imperfect strike and an imperfect path of the putter 100 as recorded by the recording device 140. In this case, the face 15 of the putter 100 is not corrected, which results in a faulty strike. After correcting the face 15 of the putter 100, a perfect strike is obtained, which is illustrated in FIG. 5*b*. For correcting the path of the putter 100, the golfer has to practice the piston-like motion which teaches the golfer to move the putter 100 in a piston-like action along a straight line.

In another embodiment of the present invention, a direction guide is installed in the grid 200 to record the trajectory of the ball 300 after it is hit. The direction guide helps the golfer in "reading the greens" before and after the putt.

Figure 7:
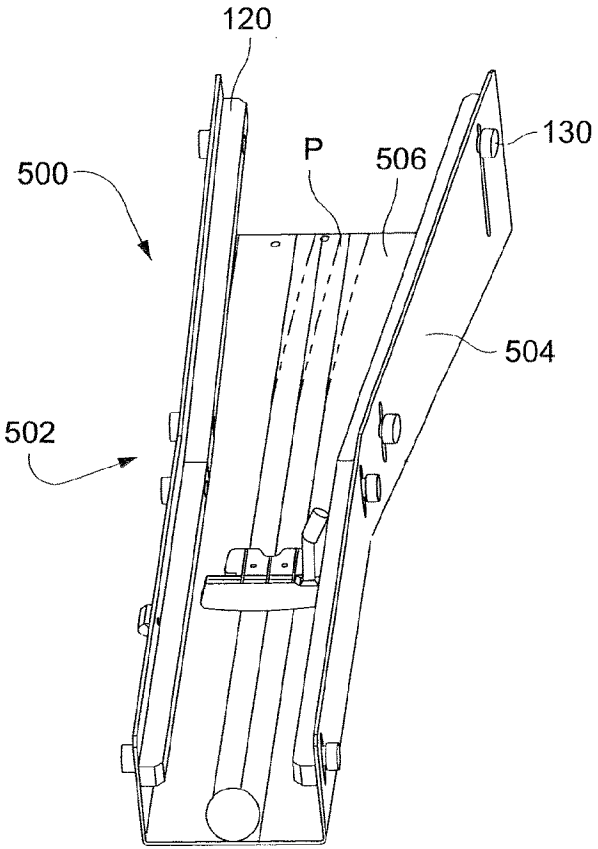
FIGS. 6 and 7 are perspective views showing a putter training system including a putter with various attachments.
Figure 6:
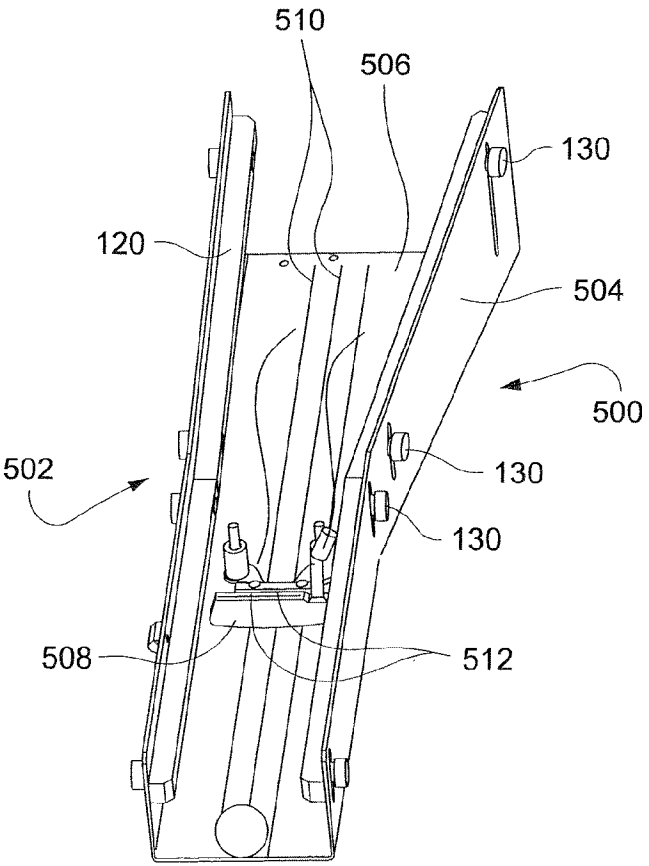

FIGS. 6-12 illustrate alternative embodiments of the invention. FIGS. 6 and 7 show a modified grid system 500 including a grid 502 with side walls 504 and a grid bottom 506. As shown, the side walls 504 are spaced apart by a distance larger than a length of the putter head 508. The grid bottom 506 is preferably provided with one or more grid alignment lines 510, preferably three. The putter head 508 similarly includes at least one putter alignment line 512 on a top portion of the putter head 508. The putter alignment lines 512 may be etched in an upward facing surface of the putter head 508. As shown, in a preferred construction, the top of the putter head 508 includes three putter alignment lines 512, and the grid bottom 506 includes three corresponding grid alignment lines 510. The putter alignment lines 512 and the grid alignment lines 510 are equally spaced and similarly oriented relative to one another. In this manner, the corresponding alignment lines 510, 512 facilitate alignment perception during a putting stroke.

Figure 8:
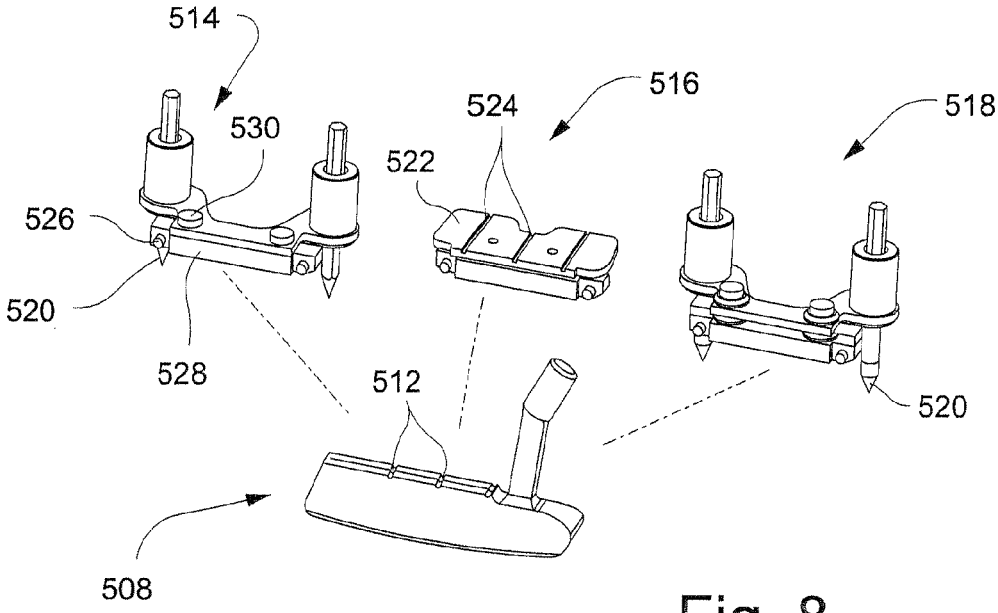
FIG. 8 shows a putter and interchangeable attachments.
Figure 9:
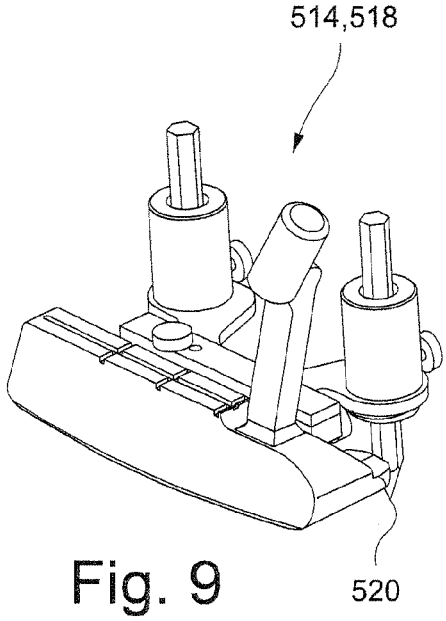
FIG. 9 is a perspective view of a putter head including a stylus attachment.
Figure 10:
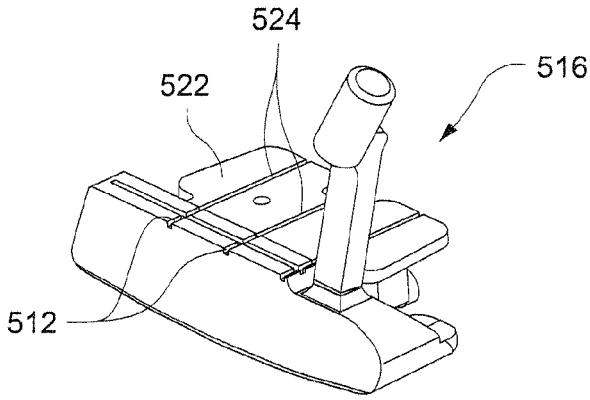
FIG. 10 is a perspective view of a putter head including an alignment plate attachment.
Figure 11A:
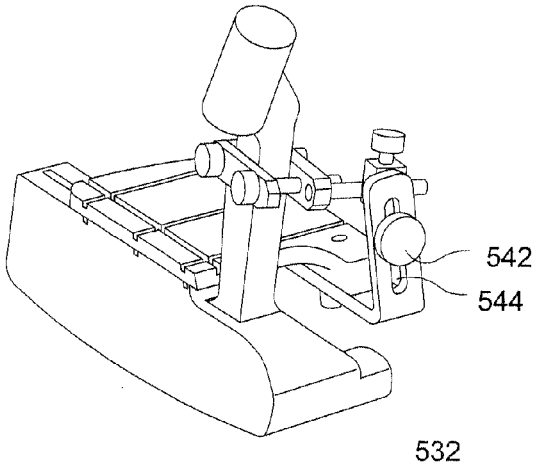
FIGS. 11*a*-11*e* show various views of a universal aiming plate attachable to any putter.
Figure 11B:
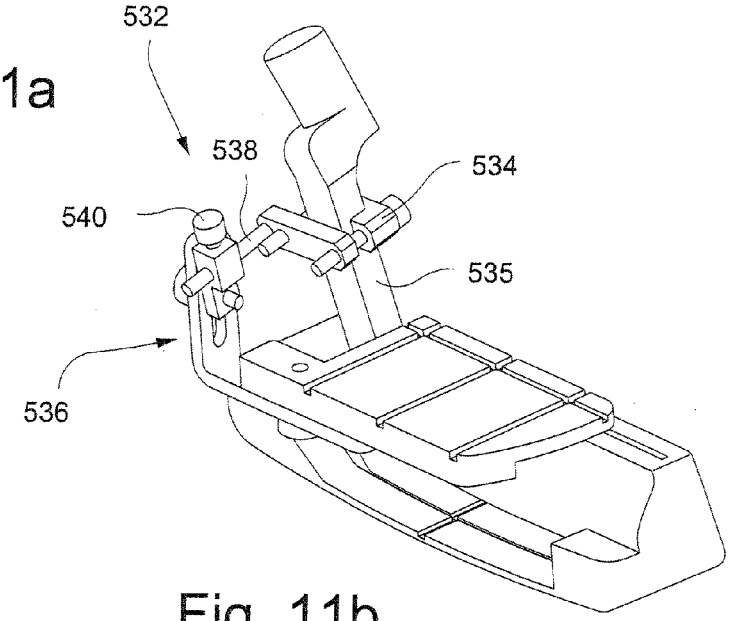
Figure 11C:
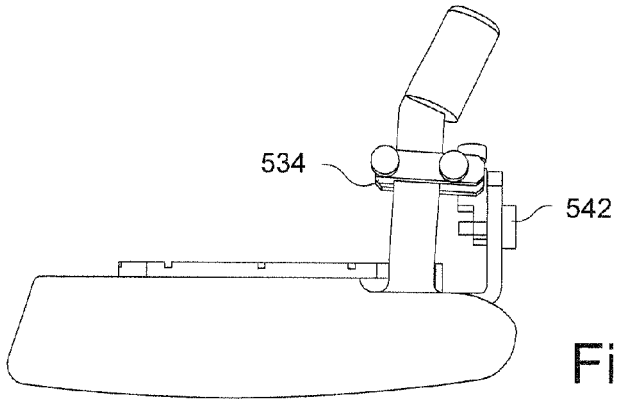
Figure 11D:
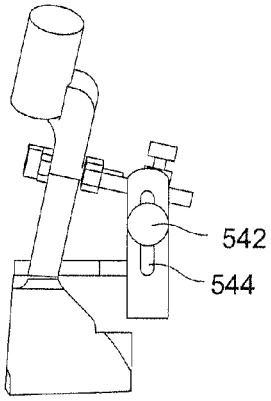
Figure 11E:
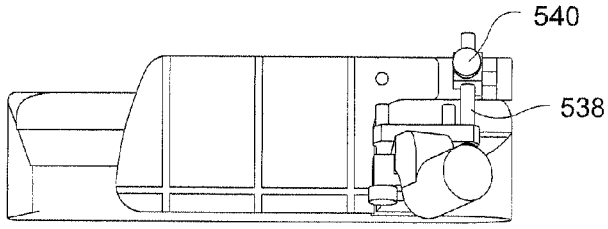
Figure 12A:
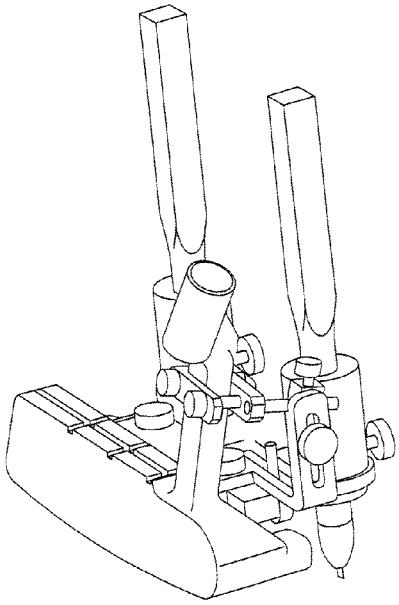
FIGS. 12*a*-12*e* show various views of a universal stylus attachment attachable to any putter.
Figure 12B:
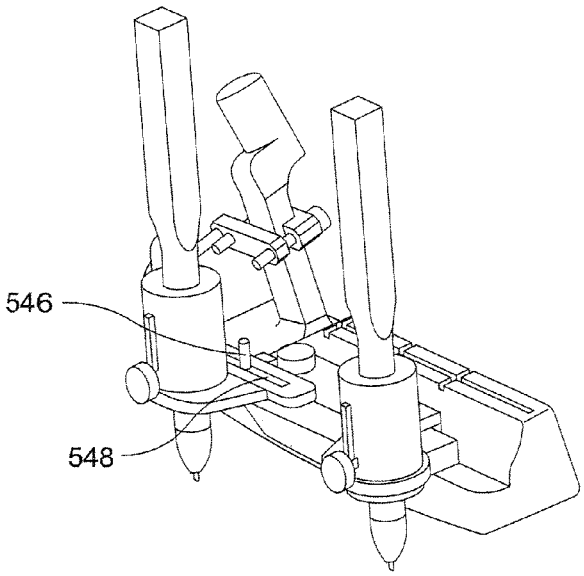
Figure 12C:
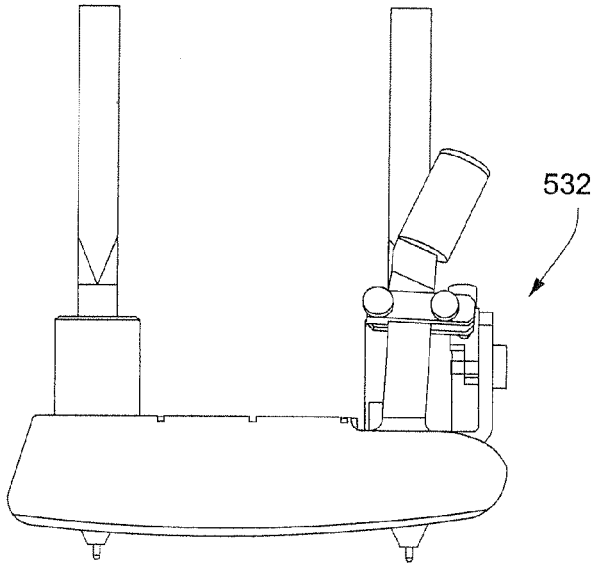
Figure 12D:
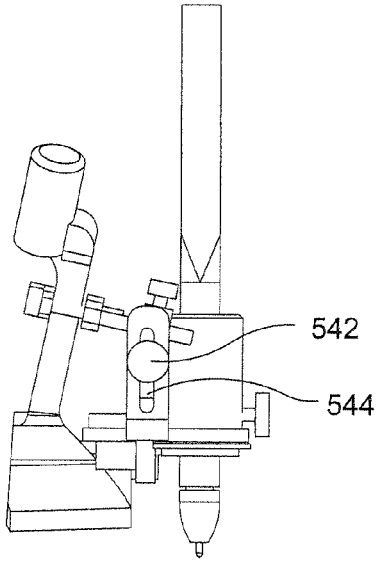
Figure 12E:
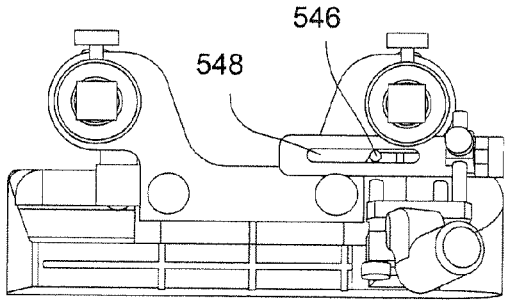

With reference to FIGS. 8-10, the putter head 508 may be provided with an attachment 514, 516, 518 that facilitates alignment feedback during the putting stroke. Exemplary attachments include a carbon or pencil stylus attachment 514, an alignment plate attachment 516, and a computer stylus attachment 518. The stylus attachments 514, 518 have a marking end 520 disposed below a bottom of the putter head 508 when attached to the putter head. The stylus 520 is positioned to mark the grid bottom 506 according to a path of the putter head 508 during the putting stroke. In one embodiment, the grid bottom 506 comprises a markable surface, where the stylus 520 comprises a pencil. Alternatively, the grid bottom 506 may comprise a touch sensitive or light sensitive electronic screen, where the stylus 520 comprises an implement that is cooperable with the electronic screen. The alignment plate attachment 516 includes an aiming plate 522 securable adjacent the putter head 508. The aiming plate 522 includes at least one plate alignment line 524, preferably three as shown, in line with the one or more putter alignment lines 512. The aiming plate 522 of the alignment attachment 516 similarly provides alignment feedback during the putting stroke as the user can visualize whether the putter head 508 is being maintained on line during the putting stroke by comparing a position of the plate alignment lines 524 and putter alignment lines 512 with the grid alignment lines 510.

The attachments 514, 516, 518 are each secured to the putter head 508 by any suitable connecting means. It is preferable that the attachment be removably attached to the putter head. Exemplary attachment means include a machine screw 526 or the like secured in a threaded opening in a back side of the putter head 508 and/or a connecting bar 528 receiving screws 530 or the like and into threaded openings in a top portion of the putter head 508. It is desirable for the putter training system to include multiple attachments 514, 516, 518 that can be interchangeably attached to the putter head 508 depending on a desired use and grid type.

FIGS. 11*a*-11*e* and FIGS. 12*a*-12*e* show various views of a universal attachment assembly for securing the attachments 514, 516, 518 to any putter or other club. The attachment assembly 532 includes a first bracket 534 securable to a hosel 535 of the putter. A second bracket 536 is connected to the first bracket 534. As shown, the first bracket 534 is securable to the hosel 535 in a desired position. The second bracket 536 is movable relative to the first bracket 534 via a pin 538 and lock 540 mechanism. The second bracket 536 is also pivotable relative to the first bracket 534 on the pin 538. The second bracket 536 is movable up and down relative to the first bracket 534 via a clamp 542 and slot 544 mechanism.

In an exemplary construction, the second bracket 536 is generally L-shaped with the clamp 542 and slot 544 mechanism on the vertical leg of the L-shape. The attachment 514, 516, 518 is secured to the horizontal leg of the L-shape. As shown most clearly in FIGS. 12*b* and 12*e*, the attachment 514, 516, 518 may also be movable across a face of the putter head 508 via a pin 546 and slot 548 mechanism in a horizontal leg of the L-shaped second bracket 536. FIGS. 11*a*-11*e* show the alignment attachment 516 secured to the putter. FIGS. 12*a*-12*e* show the stylus attachments 514, 518 secured to the putter. Since the second bracket 536 is positionable relative to the first bracket 534, the attachments 514, 516, 518 can be adjustably positioned relative to the putter head into a use position by manipulation of the brackets 534, 536.

The putter training system trains a golfer to utilize an advantageous piston motion technique for better putting. The piston motion is more linear than a traditional pendulum swing, making it easier to repeat, resulting in more consistent putting.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. An attachment assembly securable to a putter for use as a training aid, the attachment assembly comprising:

a first bracket securable to a hosel of the putter;

a second bracket connected to the first bracket; and an attachment secured to the second bracket, wherein the second bracket is adjustable relative to the first bracket to position the attachment in a use position adjacent a putter head of the putter, and wherein the attachment includes at least two interchangeable attachments including (1) a stylus having a marking end, the stylus being positioned to mark a path of the putter head during a putting stroke, and (2) an aiming plate securable adjacent the putter head.

2. An attachment assembly according to claim 1, wherein the marking end is disposed below a bottom of the putter head.

3. An attachment assembly according to claim 1, wherein the stylus comprises a pencil.

4. An attachment assembly according to claim 1, wherein the stylus comprises an implement that is cooperable with an electronic screen.

5. An attachment assembly securable to a putter for use as a training aid, the attachment assembly comprising:

a first bracket securable to a hosel of the putter;

a second bracket connected to the first bracket; and an attachment secured to the second bracket, wherein the second bracket is adjustable relative to the first bracket to position the attachment in a use position adjacent a putter head of the putter, the attachment comprising three interchangeable attachments including a pencil stylus with a marking end disposed below a bottom of the putter head, an electronic stylus cooperable with a touch sensitive or light sensitive electronic screen, and an aiming plate securable adjacent the putter head.

6. An attachment assembly cooperable with a putter for use as a training aid, the attachment assembly comprising:

an aiming plate securable adjacent a putter head of the putter, the aiming plate including at least one plate alignment line; and a stylus having a marking end positioned to mark a path of the putter head during a putting stroke, wherein the aiming plate and the stylus are interchangeably attachable to the putter, and wherein the stylus comprises one of a pencil stylus with a marking end disposed below a bottom of the putter head and an electronic stylus cooperable with an electronic screen.

7. An attachment assembly according to claim 6, wherein the electronic stylus comprises a stylus end cooperable with one of a touch sensitive or a light sensitive electronic screen.

8. An attachment assembly according to claim 6, further comprising:

a first bracket securable to a hosel of the putter; and a second bracket connected to the first bracket, wherein the aiming plate or the stylus is secured to the second bracket, and wherein the second bracket is adjustable relative to the first bracket to position the aiming plate or the stylus in a use position adjacent a putter head of the putter.

9. An attachment assembly according to claim 8, wherein the second bracket is L-shaped, a vertical leg of the L-shape being movably secured to the first bracket, and a horizontal leg of the L-shape supporting the aiming plate or the stylus.

10. An attachment assembly according to claim 9, wherein the vertical leg of the second bracket L-shape comprises a slot therein receiving a clamp to which the second bracket is attached.

* * * * *